United States Patent [19]
Samuelsson
[11] 4,193,244
[45] Mar. 18, 1980

[54] BUILDING BLOCK AND MODULE SYSTEM FOR HOUSE BUILDING

[76] Inventor: Sture L. Samuelsson, Askvägen 2 D, 752 52 Uppsala, Sweden

[21] Appl. No.: 897,315

[22] Filed: Apr. 18, 1978

[30] Foreign Application Priority Data

Apr. 19, 1977 [SE] Sweden ..... 7704477

[51] Int. Cl.² ..... E04C 2/10

[52] U.S. Cl. ..... 52/582; 52/809; 52/821; 428/119

[58] Field of Search ..... 428/106, 188, 157, 177, 428/119, 120; 156/250; 144/309 R, 314 R, 315 R; 52/612, 615, 584, 408, 409, 618, 629, 281, 273, 582, 809, 821, 627

[56] References Cited

U.S. PATENT DOCUMENTS

| | | | |
|---|---|---|---|
| 1,123,417 | 1/1915 | Steele | 217/5 |
| 1,362,764 | 12/1920 | Warner et al. | 52/281 |
| 1,853,803 | 4/1932 | Dreisel | 52/584 |
| 3,793,789 | 2/1974 | Greenamyer | 52/615 |

FOREIGN PATENT DOCUMENTS

| | | | |
|---|---|---|---|
| 486483 | 9/1952 | Canada | 52/615 |
| 871829 | 3/1953 | Fed. Rep. of Germany | 428/119 |
| 120683 | 1/1948 | Sweden | 52/612 |

*Primary Examiner*—James L. Ridgill, Jr.
*Attorney, Agent, or Firm*—Steele, Gould & Fried

[57] ABSTRACT

Heat insulated building blocks and airtight module systems for house building are disclosed. The building blocks comprise a pair of parallel-spaced base plates of equal size and a body of heat insulating material, which is disposed in the space between the base plates. Each base plate has an elongated support member, e.g. a wooden stud, attached at each longitudinal edge thereof and extending edge to edge with the respective longitudinal edge. The support members of at least one of the base plates are located on the outside of the building block. The two base plates are connected by means of two side plates of sheet material, which are secured to opposite support members of the base plates.

9 Claims, 9 Drawing Figures

BUILDING BLOCK AND MODULE SYSTEM FOR HOUSE BUILDING

BACKGROUND OF THE INVENTION

The present invention relates to a new type of building blocks and module systems for the production of highly insulated and airtight buildings, especially small houses.

Most of the presently produced building blocks for house building essentially consist of two parallel plates of sheet material, which are spaced apart and interconnected by means of wooden studs. An insulating material is usually arranged in the space between the plates and the studs. These known prefabricated building blocks are made as complete as possible, with a finished interior side and a finished exterior side. By this far reaching prefabrication of the building blocks, these systems become unflexible. For example, it is not possible to place utilities such as electric installations in the block afterwards, i.e. when erecting the building. It is also difficult to join the known building blocks together such that the joints between the blocks become sufficiently airtight.

The increasingly more severe requirements on heat insulation in house building have also created an urgent need of stud constructions having better insulation properties than the conventionally used studs of solid wood, which give rise to undesired cold bridges. As a result different types of composite studs for e.g. prefabricated building blocks have been developed. However, most of these composite studs are complex, expensive to produce, have insufficient strength and/or heat insulation properties.

SUMMARY OF THE INVENTION

It is an object of the present invention to eliminate the disadvantages of these prior art constructions. To this end the invention provides building blocks and module systems for house building, which make it possible to rapidly build up a very airtight and highly insulated housing framework by means of a very small number of basic blocks, which are easy to produce, have a low weight and in principle lack undesired cold bridges in the form of through-studs. The building blocks according to the invention can be erected and assembled in a very simple manner. Another essential advantage is that the interior side of the erected blocks is not completely finished, but may be completed afterwards with a suitable inner lining such as a boarding or suitable plates. Thus, the building blocks according to the invention have space available for making electric and other installations such as means for the distribution of hot air before the inner lining is applied. One can thus rapidly erect an airtight and heat insulated housing framework, within which the necessary installation works can be done. The building blocks according to the invention can be used as wall units and also as floor and roof units. In wall units the same module block can be used as an "ordinary" wall unit, as corner unit and, for example, as wall units ("headers") over windows. These and other advantages of the invention are illustrated in more detail in the following description.

An essential feature of the invention is that at least some of the studs in each module block are located on the outside of the parallel plates of the blocks, instead of being located in the space between said plates. Each module block thus comprises, in a known manner, two plates of the same size, which are parallel-spaced opposite to each other, and a heat insulating material disposed in the space between the plates. According to the invention an elongated support member, preferably a wooden stud, is secured to each of the long side edges of each plate and extends along the respective long side edge, edge to edge with the same, the support members of at least one of the plates being located on the outside thereof. Said two plates are interconnected by means of two side plates of sheet material, which are secured to opposite support members and have the same length as the latter. In this manner a building block is obtained, which comprises a continuous insulation layer, which is not interrupted by studs forming cold bridges, the support members located on the outside of the blocks forming means of attachment for joining adjacent blocks together in a simple and airtight manner, as described in further detail below.

The invention also relates to a method of producing the new module blocks, which makes industrial scale production possible. In the method according to the invention wooden studs or the like are arranged in parallel and at fixed distances from each other on a sheet material such as fibre board, especially hard fibre board. The width of the wooden studs is about twice the desired width of the support members of the finished module blocks. After glueing the wooden studs onto the sheet material, the unit formed by the studs and the sheet material are severed along the studs and essentially through the centre line thereof such that—after possible severing to the desired length—module plates are obtained having one stud part secured at each long side edge. If desired, supplemental nogging pieces can be arranged, e.g. for nailing vertical boarding on the module blocks, for discharging part of the load to the plates, as bracings for top blocks, etc., as explained below.

Two such module plates are then attached to each other by means of side plates of the same length and width as the desired size of the module block. A body of a heat insulating material such as mineral wool is arranged in the space between the module plates and the side plates. The studs of the module plates are arranged in such a manner, that at least the studs of one of the module plates are located on the outside of said space.

DESCRIPTION OF PREFERRED EMBODIMENTS

Figure 1:
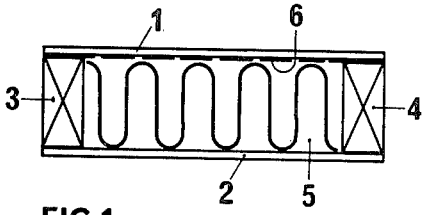
Figure 3:
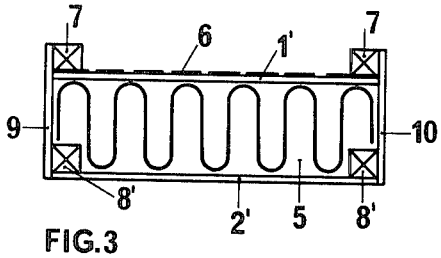
Figure 2:
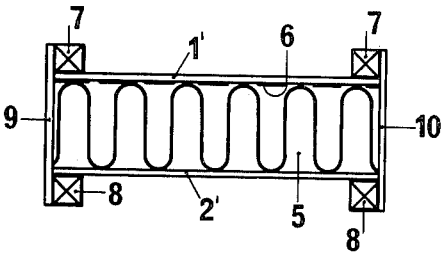
Figure 4:
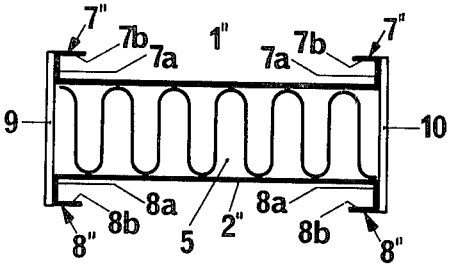
Figure 5:
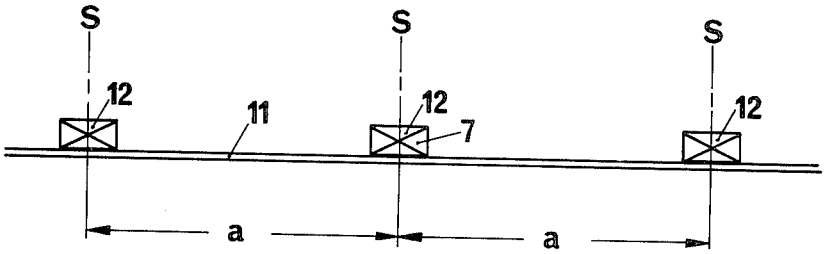
Figure 6:
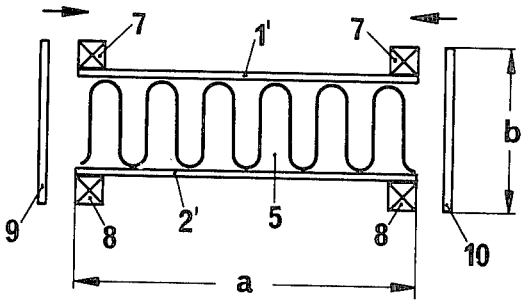
Figure 7:
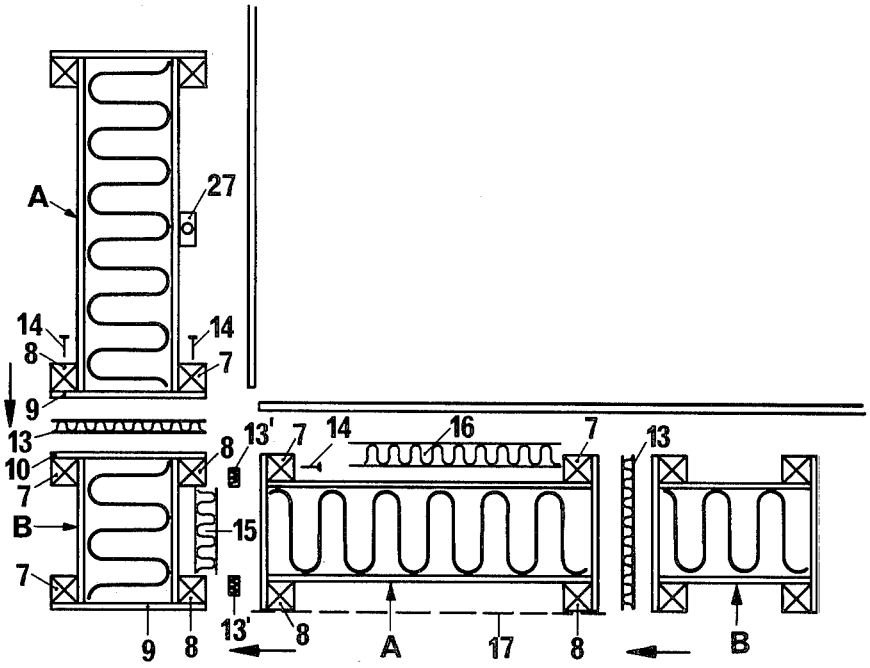
Figure 9:
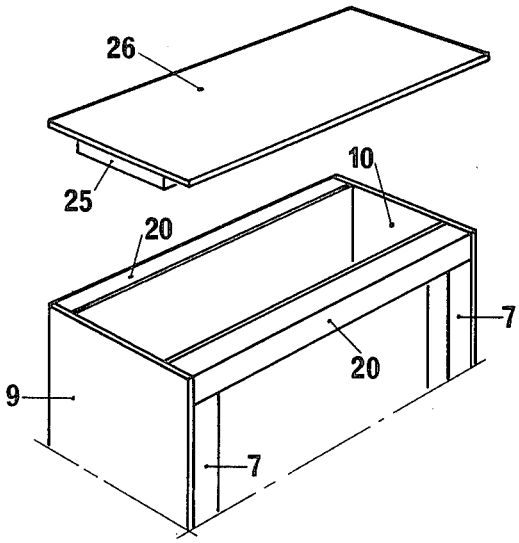
Figure 8:
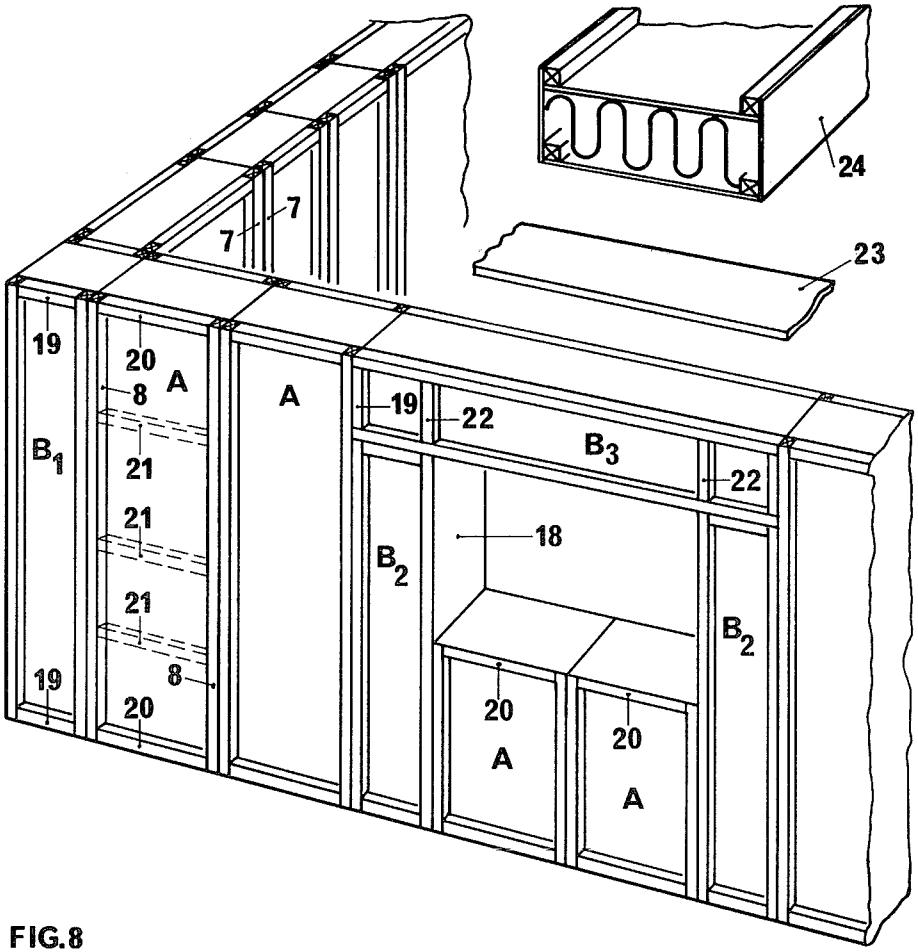

Some preferred embodiments of the invention will now be described with reference to the enclosed drawings, in which FIG. 1 is a schematic cross sectional view of a conventional module block for house building, FIGS. 2, 3 and 4 are corresponding views of three different embodiments of the module block according to the invention, FIGS. 5 and 6 illustrate a preferred method of producing the module blocks according to the invention, FIG. 7 is a schematic view showing how module blocks according to the invention can be joined together, FIG. 8 is a perspective view showing parts of a house wall built up of module blocks according to the invention, and FIG. 9 is a perspective view of a detail of the module blocks according to the invention.

FIG. 1 schematically shows how a conventional module block for house building is built up. In principle, such blocks consist of two base plates 1, 2, which are joined together by means of two wooden studs 3, 4 occupying part of the space between the base plates 1 and 2. A body 5 of an insulating material is arranged between the plates 1, 2 and the studs 3, 4. A diffusion barrier 6 is located on the inside of one of the plates 1. This prior art module block is completely closed, making it impossible—or at least very complicated—to afterwards introduce e.g. electric installations, hot air channels, etc. If such installations after all are made, the diffusion barrier 6 will be destroyed. Furthermore, the studs 3, 4 form undesired cold bridges.

In FIG. 2 there is schematically shown a first embodiment of a module block according to the invention, which in analogy with the block of FIG. 1 has two parallel base plates 1', 2', a diffusion barrier 6 and an intermediate insulation body 5. However, instead of the intermediate studs 3, 4, the module block according to the invention is provided with exterior support members such as wooden studs 7 and 8 respectively, which are secured—preferably glued and/or nailed—to the respective base plate 1' or 2' and extend edge to edge with said base plate along the long side edges thereof. The base plates 1', 2', of the module block according to the invention can be made of thinner sheet material than the plates 1, 2 in the conventional module block according to FIG. 1.

The module block according to the invention is kept together by two side plates 9, 10 of a suitable sheet material such as fibre board, plywood, particle board, or the like. These side plates are secured, e.g. nailed and/or glued, to opposite studs 7, 8, and they extend from the outer edge of one stud 7 to the outer edge of one stud 8, such that the width thereof corresponds to the thickness of the module block. In the module block according to the invention the entire space between the base plates 1', 2' and the side plates 9, 10 is thus available for the insulating material 5, and the side plates 9, 10 only form insignificant cold bridges. As is further described below adjacent module blocks can be connected by means of suitable fasteners, driven through adjacent studs 7 (8), and different kinds of installations can be placed in the space formed between the studs 7 (or 8) of one and the same module plate 1' (or 2') before an inner lining is attached to the studs 7 and an external cladding to the studs 8. Such installations can be provided without destruction of the diffusion barrier 6.

In FIG. 3 there is schematically shown an alternative embodiment, in which the studs 8' of one base plate 2' are located in the space between the two base plates 1' and 2'. For the rest the construction is the same as the one shown in FIG. 2. This embodiment can be used when it is desired to provide the module block with one smooth side already from the start, for example for use as floor blocks. Also in this case it is possible to join two adjacent module blocks by using the studs 7 as supports for nails or other suitable fasteners. As the internal studs 8' only occupy part of the distance between the plates 1' and 2' no essential impairment of the heat insulation of the block occurs. The possiblity of locating different installations in the space between the studs 7, which are located on the outside of the block, is maintained. FIG. 3 also shows that the diffusion barrier 6, as an alternative, can be located on the outside of the plate 1'.

In FIG. 4 there is shown an example of still another alternative embodiment of the module block according to the invention, in which the base plates 1'' as well as the support members 7'', 8'' are made of metal plate material such as galvanized steel plate. The plates 1'', 2'' and the studs 7'', 8'' are preferably made integral. The module plates 1'', 2'' are equivalent with the base plates 1', 2' in FIGS. 2 and 3 with attached studs 7, i.e. each base plate 1'' (2'') has, in addition to the part corresponding to the plate 1' (2'), first parts 7*a* (8*a*), which are perpendicular to the plate and serve as attachments for the side plates 9, 10, and second parts 7*b* (8*b*), which are parallel with the plate and serve as attachments for an inner lining and an external cladding respectively on the modular block. The use of heat conducting metal material is made possible by the fact that this material extends essentially in parallel with the blocks and not across the same. The side plates 9, 10 of heat insulating sheet material (e.g. plywood, fibre board, particle board, etc.) are attached to the parts 7*a*, 8*a* in a suitable manner, for example by means of glue screws, pop rivets, barbs which have been punched out in the parts 7*a*, 8*a*, or the like. Adjacent module blocks can be joined by means of e.g. self-tapping screws, pop rivets or the like.

FIGS. 5 and 6 schematically illustrate how module blocks according to the invention can be produced. In a first step wooden studs 12 are arranged in parallel on a large sheet 11 and glued thereto at a given distance a from each other. The distance a corresponds to the width of a finished module block, the side plates 9, 10 being disregarded. Each glued stud 12 is then severed along its center line S to produce a number of base plates having edge studs 7 glued thereon. Each stud 12 then forms an edge stud 7 (8) on two different base plates. The studs 12 can be secured to the sheets 11 by means of conventional glueing methods. Supplemental framing such as nogging pieces may be secured to the sheet 11 simultaneously with the studs 12. Such supplemental nogging pieces may be desired for e.g. attaching vertical boardings, for the transfer of load from the studs to the plates at the short ends thereof, for bracings, headers, and the like.

FIG. 6 illustrates a method of producing a module block from two module plates 1', 2', produced in accordance with FIG. 5, two side plates 9, 10 and an insulating body 5. (The diffusion barrier 6 is preferably provided already on the large sheet 11, but it can, of course, also be provided separately on the respective base plate afterwards.) During manufacture the side plates 9, 10 are secured, e.g. glued and/or nailed, to the respective studs 7, 8 parallel to the outer ends thereof such that the thickness b of the block will be essentially the same as the width of the side plates. At the same time a heat insulating body 5 is placed in the space between the base plates 1', 2', and the side plates 9, 10. All of these steps are preferably made in a factory, but it is within the scope of the general inventive idea possible to prefabricate only the parts shown in FIG. 6—i.e. the module plates 1' (2') with attached studs 7 (8), the side plates 9, 10, and suitable insulating bodies 5—and to assemble the module block illustrated in FIG. 6 only at the building place. In the latter case it is, if desired, possible to use only one side plate 9 (10), which is common to two adjacent module blocks. This may in particular be desirable when the module blocks have module plates 1'', 2'' of metal plate material (see FIG. 4). FIG. 6 illustrates the production of a module block according to FIG. 2, but by turning the module plate 2' with the studs 8 inwardly a module block according to FIG. 3, e.g. a floor block, can be produced in an analogous manner.

FIGS. 7 and 8 illustrate how adjacent module blocks according to the invention can be assembled in a simple manner and how a complete house wall, including window framing and corners, can be built up with only two block dimensions. In FIG. 7 there is shown how two broader blocks A are connected at a corner by means of a narrower block B. The width and depth of the narrower block B in this case equal to the thickness of the broader blocks A. The dimension of the blocks can, of course, be varied within the scope of the general inventive idea, but according to a preferred embodiment the blocks A have dimensions of about 30×60 cms and the blocks B of about 30×30 cms.

The erection of the house wall may, for example, be started by positioning the corner block B on the desired place. One block A is then positioned next to the corner block B with the adjacent studs of the blocks in alignment with each other. The blocks are then secured to each other by means of fasteners 14, which are driven through the adjacent studs 7, 8. Suitable fasteners are, for example, binding clips, self-tapping screws, roll-threaded nails, or the like. As the studs 7, 8 are available from the outside of the module blocks the erection work is very simple, and it is possible to obtain very airtight joints between the blocks. The tightness of the joints can, however, be further improved by disposing a sealing material 13, 13' between the blocks. It is, for example, possible to use a sheet-formed sealing material 13, which covers the entire surfaces of the side plates 9, 10, or as an alternative use elastic sealing strips 13' (of rubber, plastic or the like), e.g. extending parallel with the studs 7, 8. Another wall block is then erected in an analogous manner, and so on.

When using, as in FIG. 7, a corner block B, in which all of the studs 7, 8 are located on the outside of the block, an empty space is formed between the studs 8 of the block B. This space is suitably filled with an insulating body 15 before the erection. As an alternative the studs 8 can be placed inside the block B (compare FIG. 3), eliminating the need of an extra insulating body 15. The width of the side plates 9, 10 of the block B should, of course, remain unchanged. When all of the module blocks have been assembled in this manner, completely airtight and heat insulated wall structure is obtained, which on the interior side (and also on the exterior side) has space available for e.g. electric installations, hot air channels, etc., which in FIG. 7 are marked by the reference designation 27. In case of need it is also possible to place an extra insulation 16 in the available space. In all of these works the diffusion barrier 6 remains completely intact.

When the desired wiring work, etc. has been done, the interior side of the wall is provided with a suitable inner lining such as gypsom plates, particle board, fibre board or the like, which is secured to the available nailing studs 7. Similarly, a facade cladding 17 may be applied on the studs 8, but as the need of installations, etc. on the exterior side of the wall is considerably less, it is also possible to provide the module blocks with a facade cladding already from the beginning. The same technique can be used for floor and roof constructions, wherein a suitable floor or roof covering in the same manner is applied to the available studs after the necessary installations have been made in the space between the same.

FIG. 8 is a schematic perspective view showing an example of walls and a roof built up from module blocks according to the invention. For the walls only the two block widths shown in FIG. 7 are used, having varying lengths. In the illustrated case each block is provided with nogging pieces 19, 20, extending edge to edge with the short ends of the base plates. The nogging pieces 19, 20 make it possible to e.g. nail the module blocks for e.g. securing them to a foundation plate, and they assist in transferring the load to the base plates to avoid too great point loads from the studs 7, 8. In this case a rigid unit is formed, in which loads are taken down in the studs as well as in the base plates ("stressed-skin panels"). FIG. 8 also schematically illustrates that the module blocks according to the invention can be provided with supplemental nogging pieces 21 between the short ends of the blocks, for example as a support for vertical boardings. As mentioned above also the nogging pieces 19, 20, 21 can be applied during the manufacture of the module plates 1, 7, 8 (see FIG. 5), and they consequently do not complicate the method of manufacture.

In FIG. 8 a window opening 18 is formed by using two shortened module blocks of type A, which on both sides are surrounded by shortened support blocks B2 for a horizontal upper block B3. The upper block B3 above the window opening is provided with bracing studs 22, which during the manufacture are attached to the base plate in the same manner as the nogging pieces 19, 21. In this manner it is possible to provide in a simple manner, openings for windows of standard size, openings for standard doors, and the like. The invention thus makes it possible to produce a complete wall structure, having the necessary door and window openings, by means of module blocks of only two widths, having varying lengths. However, it is, of course, also possible to use several types of module blocks for special purposes, if desired.

When all of the wall blocks have been erected a connecting or block closing member 23 is disposed at the tope of the blocks. The wall structure can then be provided with floor or roof blocks, which may consist of module blocks according to the invention or be designed differently. In FIG. 8 a module block 24 of the kind shown in FIG. 3, i.e. a block having a smooth underside, is used for this purpose.

The module blocks according to the invention can be sealed at the top and at the bottom in a very simple matter, as the space between the side plates 9, 10 and the base plates 1', 2' has an essentially uninterrupted rectangular form. It is thus possible to close these ends in the simpliest possible manner, e.g. by using two elongated sheets of different widths, which are glued onto each other, as is illustrated in FIG. 9. The bottom sheet 25 has such a width, that it can be fitted between the base plates 1', 2', whereas the top sheet 26 can be broader and abut the outer studs 20 (alternatively 7, 8) of the module block. The length of the sheets is adjusted such that the sheet 25 fits in between the side plates 9, 10. The closing block 25, 26 can be manufactured in the simpliest possible manner by glueing a sheet 25 onto a sheet 26 and severing the unit formed to the desired lengths. It should in this connection be noticed, that FIG. 9 shows an alternative design of the load distributing nogging pieces 20, which in this case extend all over the width of the module block, whereas the longitudinal edge studs 7 (8) abut the nogging pieces 20. This embodiment offers still another possibility of avoiding too great point loads from the studs 7, 8.

The invention is, of course, not limited to the embodiments described above and shown in the drawings but many variations and modifications are possible within the scope of the invention. For example, the metal plate module blocks according to FIG. 4 can be used in full analogy with what has been shown in FIGS. 7 to 9. It is, of course, also possible to complete the module blocks shown with different details, especially for special uses. For example, it is possible to locally use stiffened side plates 9, 10 at such places, where the blocks are subjected to great point loads. The choice of the material for the different components of the blocks can also be varied. For example, the studs 7, 8 can be made of particle board material instead of solid wood.

What I claim is:

1. A module block for house building comprising two parallel-spaced base plates of wooden sheet material and of equal size and a heat insulating material disposed in the space between the base plates, wherein each of said base plates has an elongated support member of wooden material attached at each longitudinal edge thereof, the support members of at least one of said base plates being disposed on the outside of the module block, and wherein said parallel-spaced base plates are connected by means of a pair of side plates of thin wooden sheet material, which extend essentially perpendicular to said base plates and each of which is secured to one support member of one of said base plates and to one support member of the other of said base plates and wherein said base plates and side plates are constructed of different wooden materials from said support members.

2. A module block according to claim 1, wherein all of said support members are disposed on the outside of the block.

3. A module block according to claim 1, further comprising nogging pieces, which are attached to said base plates and extend edge to edge with the short end sides of said base plates.

4. A module block according to claim 1, wherein said support members consist of studs of wooden material.

5. A module system for house building, comprising at least two sizes of module blocks according to claim 1, the module blocks of the first size having a width and a thickness, which are both equal and correspond to the thickness of the module blocks of the second size.

6. A module system according to claim 5, further comprising sheets or strips of a sealing material, intended to be disposed between adjacent module blocks.

7. Structure for house building comprising a series of module blocks with each module block comprising two parallel-spaced base plates of equal size and a heat insulating material disposed in the space between the base plates, wherein each of said base plates has an elongated support member attached at each longitudinal edge thereof, with the support members of at least one of said base plates being disposed on the outside of the module block, and wherein said parallel-spaced base plates are connected by means of a pair of side plates, which extend essentially perpendicular to said base plates and each of which is secured to one support member of one of said base plates and to one support member of the other of said base plates, wherein said heat insulating material becomes continuous as said module blocks are positioned adjacent one another, except for said side plates which comprise relatively thin sheet material in contrast to said support members thereby forming only insignificant cold bridges through said structure.

8. A module block according to claims 1 or 7 wherein said support members define a space for housing utility conduits along the outer side of at least one of said base plates.

9. A method of manufacturing module blocks comprising the steps of:

forming a first module plate of a wooden material having studs of a different wooden material from said first module plate spaced parallel from one another at opposite edges and on a single side of said first module plate;

forming a second module plate of a wooden material having studs of a different wooden material from said second module plate spaced parallel from one another at opposite edges and on a single side of said second module plate;

disposing insulating material between said first and second module plates and positioning said module plates with said studs in parallel alignment with one another; and securing said first and second module plates by securing a pair of side plates of sheet material to the opposing studs of the respective module plates, said side plates extending essentially perpendicular to each of said first and second module plates.

* * * * *